United States Patent [19]

Henderson

[11] Patent Number: 5,044,011

[45] Date of Patent: Sep. 3, 1991

[54] ARTICULATED BODY ARMOR

[76] Inventor: George Henderson, 1116 Jefferson Ave., Glendale, Ohio 45246

[21] Appl. No.: 497,907

[22] Filed: Mar. 23, 1990

Related U.S. Application Data

[63] Continuation-in-part of Ser. No. 321,557, Mar. 10, 1989, abandoned.

[51] Int. Cl.[5] ..... F41H 1/02

[52] U.S. Cl. ..... 2/2.5; 2/2; 2/94

[58] Field of Search ..... 2/2, 2.5, 79, 93, 94, 2/95, 97, 227, 22, 23, 69, 85, 86, 272

[56] References Cited

U.S. PATENT DOCUMENTS

| | | | |
|---|---|---|---|
| 1,757,640 | 5/1930 | Levinson | 2/2 |
| 2,747,190 | 5/1956 | Foster | 2/2.5 |
| 2,748,391 | 6/1956 | Lewis | 2/2.5 |
| 3,514,786 | 6/1970 | Terwilliger | 2/2.5 |
| 3,634,889 | 1/1972 | Rolsten | 2/2.5 |
| 3,891,996 | 7/1975 | Leach | 2/2.5 |
| 3,973,275 | 8/1976 | Blauer | 2/2.5 |
| 4,241,457 | 12/1980 | Klein | 2/2.5 |
| 4,266,297 | 5/1981 | Atkins | 2/2.5 |
| 4,356,569 | 11/1982 | Sullivan | 2/2.5 |
| 4,384,369 | 5/1983 | Prince | 2/93 |
| 4,453,271 | 6/1984 | Donzis | 2/2 |
| 4,601,067 | 7/1986 | Buonassissi | 2/2.5 |
| 4,658,442 | 4/1987 | Tomlinson | 2/94 |
| 4,669,125 | 6/1987 | Allen | 2/94 |
| 4,694,505 | 9/1987 | Flosi | 2/2 |
| 4,715,068 | 12/1987 | Jacobson | 2/272 |
| 4,783,853 | 11/1988 | Zuber | 2/2.5 |
| 4,864,656 | 9/1989 | Nesse | 2/97 |
| 4,884,295 | 12/1989 | Cox | 2/2.5 |
| 4,922,552 | 5/1990 | Grilliot | 2/97 |

*Primary Examiner*—Werner H. Schroeder
*Assistant Examiner*—Diana L. Biefeld
*Attorney, Agent, or Firm*—John E. Halamka

[57] ABSTRACT

An articulated body armor arrangement constructed of panels of multi-layered energy absorbent material such as KEVLAR attached to an outer shell fabricated to fit the upper body and a separate lower body unit. The panel which surrounds the torso is unitarily fabricated with an overlapping opening. Each panel protects a non-hinged body part. Adjacent panels abut at hinged body joints to allow freedom of movement of the user. The resulting seam may be further protected by the application of an external shield.

19 Claims, 2 Drawing Sheets

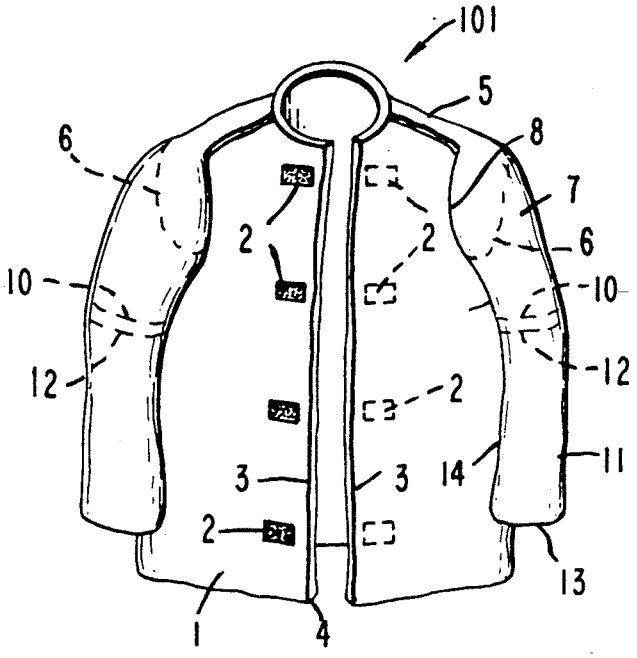
Fig. 1.
Fig. 2.
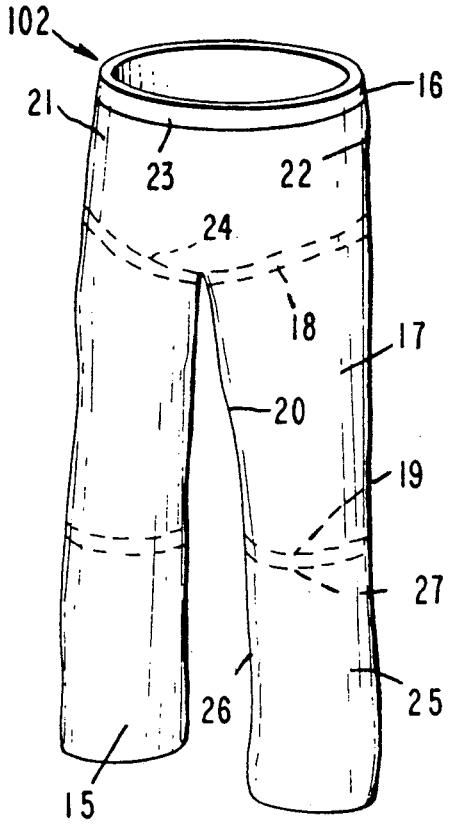
Fig. 3.
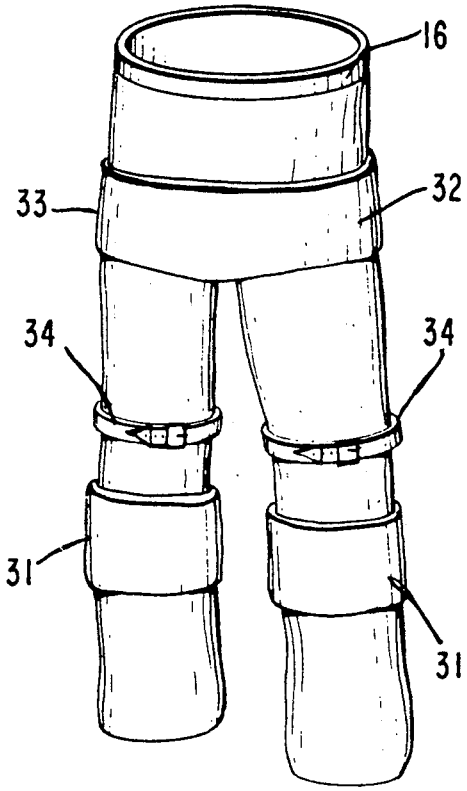
Fig. 4.
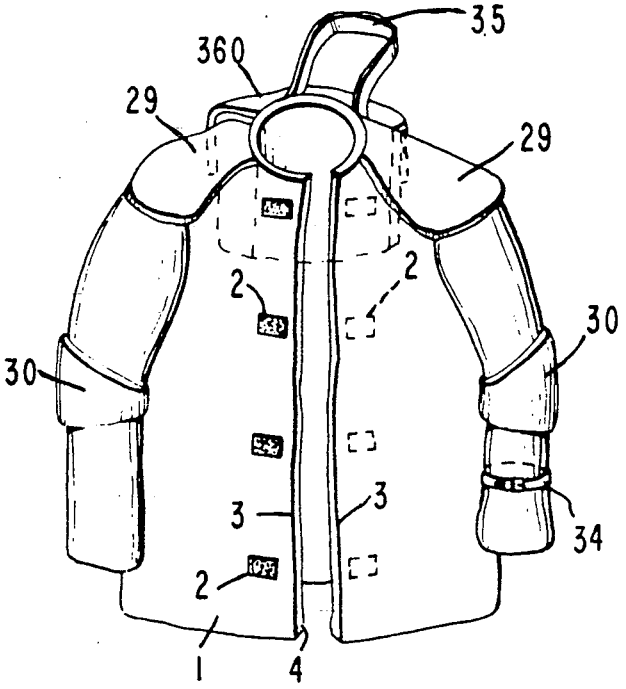

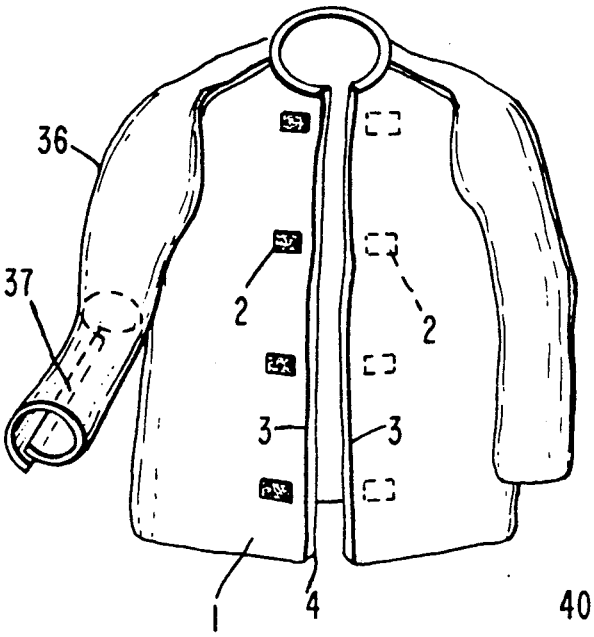
Fig. 5.
Fig. 6.
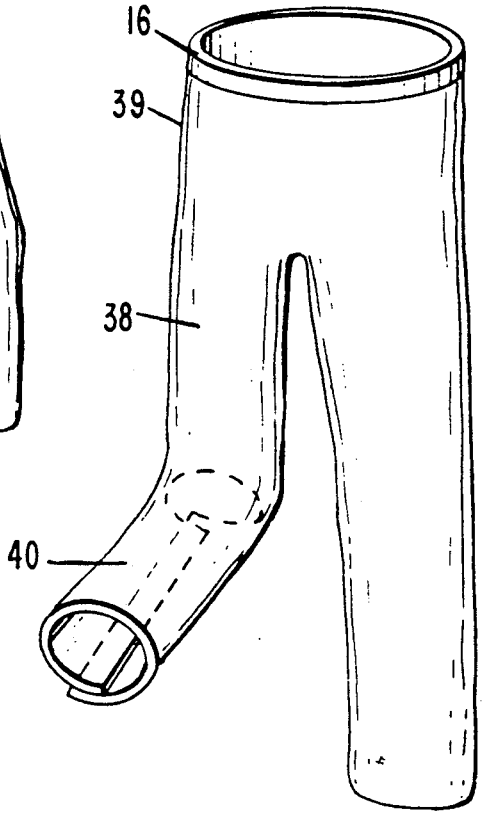
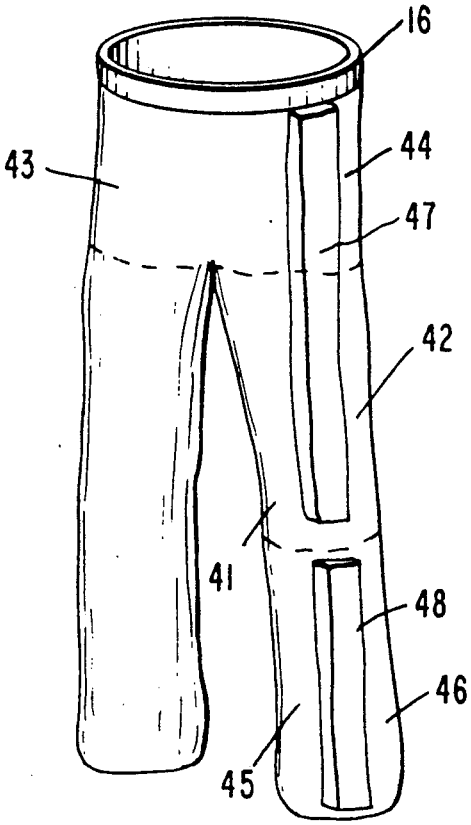
Fig. 7.

ARTICULATED BODY ARMOR

Field of the Invention

This invention is a Continuation-In-Part of application Ser. No. 07/321,557, titled Motor Vehicle Body Shield and filed Mar. 10, 1989 by the same inventor now abandoned, and relates to the art of body armor and more particularly to an articulated body suit with adjustable levels of protection.

BACKGROUND OF THE INVENTION

Description of the Prior Art

Body protection suits generally have configuration which conforms in some manner to the human body to cover areas exposed to impact by objects. These objects may be actively directed toward the user, such as projectiles, or they may be passive, such as pavement.

The prior art such as U.S. Pat. No. 4,783,853 has tried to solve the problem of total protection for the body by teaching the use of protective padding. The padding may be constructed of an outer shell of molded, rigid, high-impact resistant, sheet material coupled with softer body conforming and energy absorbing lining material such as a foam elastomer. Individual body parts are surrounded by a hinged, two part, rigid, clam shell held closed by fastener means. No provision is made to protect the body at hinged points. The rigid nature of the outer shell severely constrains the approach to body hinged elements such as knees and elbows. The overlap of rigid elements makes it impossible to sit down.

Prior art such as U.S. Pat. No. 4,266,297 teaches the use of two separate pads. One pad for the front chest area and a separate pad for the back chest area. The device leaves the user vulnerable at the shoulders and all along the area from under the arm to the waist.

Another, U.S. Pat. No. 4,639,944, teaches a combination of the above. Rigid shoulder and waist bands are coupled with the use of a pair of protective pads for the arms and legs. The pair of pads do not but up against each other and thus leave areas unprotected. Raised, ribbed folds of fabric give some measure of protection to hinged body joints. The limited size of the rigid bands solves the problem of allowing the user to sit. However, the open area between the ridged bands and between the pair of pads still leaves unprotected areas and the user vulnerable to injury.

Thus, there has long been a need for an arrangement to provide maximum body protection with the elimination of side openings and closing any other openings to a very narrow seam in the protection, if any, where necessary around hinged body joints.

It is desired that the arrangement provide a degree of comfort and maneuverability to encourage the use of the arrangement. At the very least, the user should be able to sit down or crouch down while wearing the arrangement.

It is also desired that the arrangement provide a means to adjust the level of protection from suit to suit and for selected body areas.

SUMMARY OF THE INVENTION

Accordingly, it is an object of the present invention to provide an improved arrangement incorporating continuous soft panels of layered protective material to surround selected body areas.

It is another object of the present invention to provide an improved arrangement which provides a measure of comfort and maneuverability to allow the user to be responsive to confrontational situations. At least the user should be able to sit or crouch to present a smaller profile.

It is yet another object of the present invention to provide an improved arrangement which provides the maximum protection within a weight constraint which allows the user to sprint short distances, when necessary or climb ladders or trees.

It is yet another object of the present invention to allow the user to present a side profile to the source of projectiles without reducing the level of protection.

It is yet another object of the present invention to allow the level of protection of the arrangement to be adjusted during the construction of the device or to be augmented in the field as a situation may warrant.

The above and other objects of the present invention are achieved, according to a preferred embodiment thereof, by providing a one piece, protective panel to surround a selected body area.

Additional protective shields may overlap underlying protection in areas such as upper shoulder to upper arm area. Adjacent protective panels will butt against each other in areas near hinged body joints such as groin, knees and elbows to allow movement and reduce exposure to a minimum.

In another embodiment, additional protective shields may overlay the butted seams and butted panels.

In another embodiment, the protective panels may be augmented by the insertion of additional layered protective panels in the carrier shell of the arrangement.

BRIEF DESCRIPTION OF THE DRAWINGS

The above and other embodiments of the present invention may be more fully understood from the following detailed description, taken together with the accompanying drawing, wherein similar reference characters refer to similar elements throughout, and in which:

FIG. 1 is a perspective view of the preferred upper body arrangement;

FIG. 2 is a perspective view of the preferred lower body arrangement;

FIG. 3 is a perspective view of the preferred upper body arrangement with shields;

FIG. 4 is a perspective view of the preferred lower body arrangement with shields;

FIG. 5 is a perspective view of an alternate upper body arrangement;

FIG. 6 is a perspective view of an alternate lower body arrangement; and,

FIG. 7 is a perspective view of an another alternate lower body arrangement.

DESCRIPTION OF A PREFERRED EMBODIMENT

Referring now to the drawing, FIG. 1 is shown a preferred embodiment 101 of the arrangement for the upper body.

An outer shell 1 may be fabricated of thin sheet material such as nylon, cotton or GORTEX.

Panels of bullet resistant material are attached to the outer shell. The panels may be fabricated of layers of KEVLAR or LEXAN. The number of layers determining the level of protection. For example, sixteen layers of KEVLAR provide level 1 Threat Protection and twenty for layers provide level 2 protection.

In the preferred embodiment, the torso panel 4 is fabricated of 24 layers. The arm panels are fabricated of 8 layers and the lower body panels are fabricated of 16 layers of KEVLAR. These levels of protection are selected to keep the weight of the arrangement between 25 to 30 pounds. An arrangement within these limits provides adequate protection while allowing the user freedom of movement such as a short sprint without exhaustion.

Closure means 2 are mounted adjacent the openable peripheral edges of the torso panel 4 to allow the arrangement to be put on by the user. In the preferred embodiment, the closure means 2 are mounted to insure at least a four inch overlap of the adjacent peripheral edges 3 of the torso panel 4.

The length of the upper body outer shell 1 and attached torso panel 4 may be selected to extend below the crouch of the user.

The panels may be attached to the shell leaving one edge unattached to allow the user to insert additional preselected shaped panels to increase the level of protection in preselected parts of the arrangement.

The torso panel 4 is unitarily fabricated of the selected number of layers of material. The unitary fabrication eliminates seams and unprotected areas present in protective arrangements taught by the prior art.

The torso panel front and rear shoulder peripheral edges 5 are essentially parallel. An arm opening peripheral edge 6 is formed below the shoulder peripheral edges 5.

The upper arm panel 7 is shaped to be mounted to the upper shell in a position so that the upper peripheral edge 8 abuts the shoulder peripheral edges 5 and the arm opening peripheral edge 6.

The upper arm panel 7 only extends down to the elbow peripheral edge 10 to allow a break in the arm protection. Without this break, the arm protection may be too stiff to allow the user the required freedom of movement.

Two edges of the upper arm panel 7 abut to form the upper arm peripheral edge 9.

The forearm panel 11 surrounds the forearm with two peripheral edges butting to form the forearm peripheral edge 14. The forearm panel 11 is mounted inside the upper body shell 1 so that the upper peripheral edge 12 abuts the elbow peripheral edge 10. The upper peripheral edge 12 is not attached to the elbow peripheral edge 10 to allow freedom of movement of the user.

Other embodiments such as shown in FIG. 5. demonstrate how the two edges of the upper arm panel 36 and the forearm panel 37 may overlap to provide additional protection.

Other embodiments such as shown in FIG. 3 teach the use of an external elbow shield 30 mounted on the outside of the upper body shell 1 to cover the seam between the upper peripheral edge 12 of the forearm panel 11 and the elbow peripheral edge 10 of the upper arm panel 7. This elbow shield 30 provides another degree of protection to the arrangement by protecting the user when seams must be introduced into the arrangement to provide ease of movement. Similarly a shoulder shield 29 may be added to the arrangement to protect the seams between the upper arm panel 7 and the torso panel 4.

FIG. 3 also teaches the mounting of a nap sack pocket on the upper back portion of the upper body shell. This sack may be useful for spare ammunition, etc. A grab strap 35 may also be mounted to the upper back portion to allow easy retrieval of a user who has fallen and needs assistance to gain a protected position.

FIG. 2 shows the fabrication of the lower body protection 102 according to the teaching of the present invention.

A lower body outer shell 15 is fabricated of sheet fabric material

Multi-layered panels are fabricated to provide the preselected level of protection and mounted to the lower body shell 15. One edge of each panel may be unattached to form a pocket between the shell 15 and the panel to allow the user to insert pre-formed layers of additional material to increase the level of protection of the arrangement.

A thigh panel 17 is fabricated with two peripheral edges abutting to form the thigh peripheral edge 20. The upper peripheral edge 18 is cut to conform to the hinged hip function of the user.

An abdomen and buttocks panel 21 is fabricated to surround the users abdomen and buttocks. Two edges may be mounted adjacent each other to form the abutted peripheral edge 22. The abdomen and buttocks panel 21 is mounted in the lower body shell 15 so that the lower peripheral edge 24 abuts the upper peripheral edge 18 of the thigh panel 17.

A shin and calf panel 25 is fabricated to surround the users lower leg. Two opposite edges are abutted 26. The shin and calf panel 25 is mounted in the lower shell 15 so that the upper peripheral edge 27 is adjacent the lower peripheral edge 19 of the thigh panel 17.

The thigh panel 17 is not attached to the shin and calf panel 25 to allow freedom of movement of the user.

Other embodiments as shown in FIG. 6 teach that the opposing peripheral edges of the abdomen and buttocks panel 39, the thigh panel 38 and the shin and calf panel 40 may overlap to provide additional protection by elimination of the abutted peripheral edges.

The embodiment shown in FIG. 4 teaches the use of knee shields 31 to cover the seam between the thigh panel 17 and the shin and calf panel 25 to increase the level of protection of the arrangement. In a similar method, a groin shield 32 may cover the seams between the abdomen and buttocks panel 21 and the thigh panels 17. The groin shield 32 may be attached externally to the lower shell 15. Alternatively, a pocket may be formed by another layer of material 33 in which the groin shield 32 may be removably inserted.

Straps may be mounted to the lower shell 15 at preselected locations to allow the user to adjust the configuration of the arrangement to closely fit the body proportions of the user and streamline the arrangement.

FIG. 7 shows another arrangement of the lower body protection. The abdomen and buttocks panel may be fabricated of a right and left abdomen panels 43 and right and left buttocks panels 44 to aid in conforming the arrangement to the user's body proportions. In a similar method, the thigh panel may be fabricated of a front panel 41 and a back panel 42. Similarly, the lower leg may be protected by a shin panel 45 and a calf panel 46. As discussed above, the seams between adjacent panels may be covered with shields such as the thigh shield 47 and the lower leg shield 48 to increase the protection level of the arrangement.

Since certain change may be made in the above apparatus without departing from the scope of the invention herein involved, it is intended that all matter contained in the above description, as shown in the accompanying drawing, shall be interpreted in an illustrative, and not a limiting sense.

What is claimed is:

1. An improved body armor arrangement adapted to allow the user ease of bending, and comprising, in combination:

an upper body outer shell having openable overlapping front peripheral edges;

closure means mounted on said upper body shell peripheral edges;

a unitarily fabricated, flexible, layered protective material torso panel having openable overlapping front peripheral edges, shoulder peripheral edges and peripheral edges defining arm openings, said torso panel attached inside said upper body shell with said shoulder peripheral edges being essentially parallelly adjacent;

a pair of unitarily fabricated, flexible, layered protective material upper arm panels having an upper peripheral edge compatible with and mountable adjacent said arm opening peripheral edges and said shoulder peripheral edges, abutting upper arm peripheral edges and an elbow peripheral edge, said upper arm panels attached inside said upper body shell;

a pair of unitarily fabricated, flexible, layered protective material lower arm panels having an upper forearm peripheral edge compatible with and mountable adjacent said elbow peripheral edge, a wrist peripheral edge and abutting forearm peripheral edges extending from said upper forearm peripheral edge to said wrist peripheral edge, said lower arm panels attached inside said upper body shell;

a lower body outer shell having a waist band adapted to fit over the hips of the user;

a right and left unitarily fabricated, flexible, layered protective material thigh panel having upper and lower peripheral edges and abutting thigh peripheral edges attached inside said lower body shell;

a unitarily fabricated, flexible, layered protective material abdomen and buttocks panel having two abutting peripheral edges, and upper and lower peripheral edges attached inside said lower body shell with said abdomen and buttocks panel lower peripheral edge adjacent each said thigh panel upper peripheral edge; and, a right and left unitarily fabricated, flexible, layered protective material shin and calf panels having two abutting peripheral edges, and upper shin peripheral edge and a lower ankle peripheral edge attached inside said lower body shell with said upper shin peripheral edge abutting said thigh panel lower peripheral edge.

2. The arrangement defined in claim 1 further comprising:

pockets formed between the upper body shell and attached panels whereby the user may insert a preselected number of additional layers of protective material to provide increased level of protection.

3. The arrangement defined in claim 1 further comprising:

pockets formed between the lower body shell and attached panels whereby the user may insert a preselected number of additional layers of protective material to provide increased level of protection.

4. The arrangement defined in claim 1 further comprising:

a pair of unitarily fabricated, flexible, layered protective material shoulder shields attached to the outside of said upper body shell to provide protection of the seam formed between said upper arm panel and said torso panel;

a pair of unitarily fabricated, flexible, layered protective material elbow shields attached to the outside of said upper body shell to provide protection of the seam formed between said upper arm panel and said forearm panel;

a pair of unitarily fabricated, flexible, layered protective material knee shields attached to the outside of said lower body shell to provide protection of the seam formed between said thigh panel and said shin and calf panel; and, a unitarily fabricated, flexible, layered protective material groin shield attached to the outside of said lower body shell to provide protection of the seam formed between said abdomen and buttocks shield and said pair of thigh shields.

5. The arrangement defined in claim 1 further comprising:

a pair of unitarily fabricated, flexible, layered protective material shoulder shields attached to the outside of said upper body shell to provide protection of the seam formed between said upper arm panel and said torso panel;

a pair of unitarily fabricated, flexible, layered protective material elbow shields attached to the outside of said upper body shell to provide protection of the seam formed between said upper arm panel and said forearm panel;

a pair of unitarily fabricated, flexible, layered protective material knee shields attached to the outside of said lower body shell to provide protection of the seam formed between said thigh panel and said shin and calf panel;

an external pocket attached to the outside of said lower body shell over the seam formed between said abdomen and buttocks shield and said pair of thigh shields; and, a unitarily fabricated, flexible, layered protective material groin shield formed to be insertably removal from said external pocket.

6. The arrangement defined in claim 1 further comprising:

a plurality of adjustable straps mounted at preselected points on the outside of said upper body shell to provide the user with a means to streamline the fit of said arrangement to conform to the body proportions of said user;

a nap sack pocket attached to the back portion of the upper body shell; and a pull strap attached to the back portion of the upper body shell.

7. An improved body armor arrangement adapted to allow the user ease of bending, and comprising, in combination:

an upper body outer shell having openable overlapping front peripheral edges;

closure means mounted on said upper body shell peripheral edges;

a unitarily fabricated, flexible, layered protective material torso panel having openable overlapping front peripheral edges, shoulder peripheral edges and peripheral edges defining arm openings, said torso panel attached inside said upper body shell with said shoulder peripheral edges being essentially parallelly adjacent;

a pair of unitarily fabricated, flexible, layered protective material upper arm panels having an upper peripheral edge compatible with and mountable adjacent said arm opening peripheral edges and said shoulder peripheral edges, overlapping upper arm peripheral edges and an elbow peripheral edge, said upper arm panels attached inside said upper body shell;

a pair of unitarily fabricated, flexible, layered protective material lower arm panels having an upper forearm peripheral edge compatible with and mountable adjacent said elbow peripheral edge, a wrist peripheral edge and overlapping forearm peripheral edges extending from said upper forearm peripheral edge to said wrist peripheral edge, said lower arm panels attached inside said upper body shell;

a lower body outer shell having a waist band adapted to fit over the hips of the user;

a right and left unitarily fabricated, flexible, layered protective material thigh panel having upper and lower peripheral edges and overlapping thigh peripheral edges attached inside said lower body shell;

a unitarily fabricated, flexible, layered protective material abdomen and buttocks panel having two overlapping peripheral edges, and upper and lower peripheral edges attached inside said lower body shell with said abdomen and buttocks panel lower peripheral edge adjacent each said thigh panel upper peripheral edge; and, a right and left unitarily fabricated, flexible, layered protective material shin and calf panel having two overlapping peripheral edges, and upper shin peripheral edge and a lower ankle peripheral edge attached inside said lower body shell with said upper shin peripheral edge abutting said thigh panel lower peripheral edge.

8. The arrangement defined in claim 7 further comprising:

pockets formed between the upper body shell and attached panels whereby the user may insert a preselected number of additional layers of protective material to provide increased level of protection.

9. The arrangement defined in claim 7 further comprising:

pockets formed between the lower body shell and attached panels whereby the user may insert a preselected number of additional layers of protective material to provide increased level of protection.

10. The arrangement defined in claim 7 further comprising:

a pair of unitarily fabricated, flexible, layered protective material shoulder shields attached to the outside of said upper body shell to provide protection of the seam formed between said upper arm panel and said torso panel;

a pair of unitarily fabricated, flexible, layered protective material elbow shields attached to the outside of said upper body shell to provide protection of the seam formed between said upper arm panel and said forearm panel;

a pair of unitarily fabricated, flexible, layered protective material knee shields attached to the outside of said lower body shell to provide protection of the seam formed between said thigh panel and said shin and calf panel; and, a unitarily fabricated, flexible, layered protective material groin shield attached to the outside of said lower body shell to provide protection of the seam formed between said abdomen and buttocks shield and said pair of thigh shields.

11. The arrangement defined in claim 7 further comprising:

a pair of unitarily fabricated, flexible, layered protective material shoulder shields attached to the outside of said upper body shell to provide protection of the seam formed between said upper arm panel and said torso panel;

a pair of unitarily fabricated, flexible, layered protective material elbow shields attached to the outside of said upper body shell to provide protection of the seam formed between said upper arm panel and said forearm panel;

a pair of unitarily fabricated, flexible, layered protective material knee shields attached to the outside of said lower body shell to provide protection of the seam formed between said thigh panel and said shin and calf panel;

an external pocket attached to the outside of said lower body shell over the seam formed between said abdomen and buttocks shield and said pair of thigh shields; and, a unitarily fabricated, flexible, layered protective material groin shield formed to be insertably removal from said external pocket.

12. The arrangement defined in claim 7 further comprising:

a plurality of adjustable straps mounted at preselected points on the outside of said upper body shell to provide the user with a means to streamline the fit of said arrangement to conform to the body proportions of said user;

a nap sack pocket attached to the back portion of the upper body shell; and a pull strap attached to the back portion of the upper body shell.

13. An improved body armor arrangement adapted to allow the user ease of bending, and comprising, in combination:

an upper body outer shell having openable overlapping front peripheral edges;

closure means mounted on said upper body shell peripheral edges;

a unitarily fabricated, flexible, layered protective material torso panel having openable overlapping front peripheral edges, shoulder peripheral edges and peripheral edges defining arm openings, said torso panel attached inside said upper body shell with said shoulder peripheral edges being essentially parallelly adjacent;

a pair of unitarily fabricated, flexible, layered protective material upper arm panels having an upper peripheral edge compatible with and mountable adjacent said arm opening peripheral edges and said shoulder peripheral edges, abutting upper arm peripheral edges and an elbow peripheral edge, said upper arm panels attached inside said upper body shell;

a pair of unitarily fabricated, flexible, layered protective material lower arm panels having an upper forearm peripheral edge compatible with and mountable adjacent said elbow peripheral edge, a wrist peripheral edge and abutting forearm peripheral edges extending from said upper forearm peripheral edge to said wrist peripheral edge, said lower arm panels attached inside said upper body shell;

a lower body outer shell having a waist band adapted to fit over the hips of the user;

a right and left unitarily fabricated, flexible, layered protective material front thigh panels having upper, lower, right and left peripheral edges attached inside said lower body shell;

a right and left unitarily fabricated, flexible, layered protective material back thigh panels having upper, lower, right and left peripheral edges attached inside said lower body shell with said right and left peripheral edges respectively abutting said front thigh right and left peripheral edges;

a right and left unitarily fabricated, flexible, layered protective material buttocks panels having upper, lower, right and left peripheral edges attached inside said lower body shell with said lower peripheral edges respectively abutting said back thigh panel upper peripheral edges;

a right and left unitarily fabricated, flexible, layered protective material abdomen panels having upper, lower, right and left peripheral edges attached inside said lower body shell with said lower peripheral edges respectively abutting said front thigh panels, said right and left peripheral edges respectively abutting said right and left peripheral edges of said buttocks panels;

a right and left unitarily fabricated, flexible, layered protective material shin panels having upper, lower, right and left peripheral edges attached inside said lower body shell with said upper peripheral edges respectively abutting said front thigh panel lower peripheral edges; and, a right and left unitarily fabricated, flexible, layered protective material calf panels having upper, lower, right and left peripheral edges mounted inside said lower body shell with said upper peripheral edges respectively abutting said back thigh panel lower peripheral edges and said right and left peripheral edges respectively abutting said right and left shin right and left peripheral edges.

14. The arrangement defined in claim 13 further comprising:

pockets formed between the upper body shell and attached panels whereby the user may insert a preselected number of additional layers of protective material to provide increased level of protection.

15. The arrangement defined in claim 13 further comprising:

pockets formed between the lower body shell and attached panels whereby the user may insert a preselected number of additional layers of protective material to provide increased level of protection.

16. The arrangement defined in claim 13 further comprising:

a pair of unitarily fabricated, flexible, layered protective material shoulder shields attached to the outside of said upper body shell to provide protection of the seam formed between said upper arm panel and said torso panel;

a pair of unitarily fabricated, flexible, layered protective material elbow shields attached to the outside of said upper body shell to provide protection of the seam formed between said upper arm panel and said forearm panel;

a pair of unitarily fabricated, flexible, layered protective material knee shields attached to the outside of said lower body shell to provide protection of the seam formed between said thigh panel and said shin and calf panel; and, a unitarily fabricated, flexible, layered protective material groin shield attached to the outside of said lower body shell to provide protection of the seam formed between said abdomen and buttocks shield and said pair of thigh shields.

17. The arrangement defined in claim 13 further comprising:

a pair of unitarily fabricated, flexible, layered protective material shoulder shields attached to the outside of said upper body shell to provide protection of the seam formed between said upper arm panel and said torso panel;

a pair of unitarily fabricated, flexible, layered protective material elbow shields attached to the outside of said upper body shell to provide protection of the seam formed between said upper arm panel and said forearm panel;

a pair of unitarily fabricated, flexible, layered protective material knee shields attached to the outside of said lower body shell to provide protection of the seam formed between said thigh panel and said shin and calf panel;

an external pocket attached to the outside of said lower body shell over the seam formed between said abdomen and buttocks shield and said pair of thigh shields; and, a unitarily fabricated, flexible, layered protective material groin shield formed to be insertably removal from said external pocket.

18. The arrangement defined in claim 13 further comprising:

a pair of unitarily fabricated, flexible, layered protective material shoulder shields attached to the outside of said upper body shell to provide protection of the seam formed between said upper arm panel and said torso panel;

a pair of unitarily fabricated, flexible, layered protective material elbow shields attached to the outside of said upper body shell to provide protection of the seam formed between said upper arm panel and said forearm panel;

a pair of unitarily fabricated, flexible, layered protective material knee shields attached to the outside of said lower body shell to provide protection of the seam formed between said thigh panel and said shin and calf panel;

a pair of unitarily fabricated, flexible, layered protective material thigh shields attached to the outside of said lower body shell to provide protection of the outer seam formed between said front thigh panel and said back thigh panel;

a pair of unitarily fabricated, flexible, layered protective material lower leg shields attached to the outside of said lower body shell to provide protection of the outer seam formed between said shin panel and said calf panel; and, a unitarily fabricated, flexible, layered protective material groin shield attached to the outside of said lower body shell to provide protection of the seam formed between said abdomen and buttocks shield and said pair of thigh shields.

19. The arrangement defined in claim 13 further comprising:

a plurality of adjustable straps mounted at preselected points on the outside of said upper body shell to provide the user with a means to streamline the fit of said arrangement to conform to the body proportions of said user;

a nap sack pocket attached to the back portion of the upper body shell; and a pull strap attached to the back portion of the upper body shell.

* * * * *